US008162809B1

(12) United States Patent
Eastwood

(10) Patent No.: US 8,162,809 B1
(45) Date of Patent: Apr. 24, 2012

(54) PORTABLE EXERCISE DEVICE

(76) Inventor: Greg W. R. Eastwood, Fort Lauderdale, FL (US)

( * ) Notice: Subject to any disclaimer, the term of this patent is extended or adjusted under 35 U.S.C. 154(b) by 0 days.

(21) Appl. No.: 12/546,609

(22) Filed: Aug. 24, 2009

Related U.S. Application Data

(60) Provisional application No. 61/189,840, filed on Aug. 22, 2008.

(51) Int. Cl.
*A63B 21/02* (2006.01)
*A63B 21/04* (2006.01)

(52) U.S. Cl. ..... 482/123; 482/126; 482/129

(58) Field of Classification Search ..... 482/122–124, 482/126, 129, 130, 904; 297/228.12, 273, 297/274, 281
See application file for complete search history.

(56) References Cited

U.S. PATENT DOCUMENTS

| | | | | | |
|---|---|---|---|---|---|
| 992,272 | A | | 5/1911 | Singer | |
| 1,623,671 | A | | 4/1927 | Frankenfeld | |
| 1,691,092 | A | | 11/1928 | Titus | |
| 2,655,198 | A | * | 10/1953 | Williams et al. | 297/274 |
| 3,442,513 | A | * | 5/1969 | Fisher et al. | 473/208 |
| 3,447,832 | A | * | 6/1969 | Shaw | 297/274 |
| 4,188,063 | A | * | 2/1980 | Dusart | 297/273 |
| 4,198,044 | A | | 4/1980 | Holappa | |
| 4,403,773 | A | | 9/1983 | Swann | |
| 5,141,482 | A | | 8/1992 | Hern | |
| 5,149,314 | A | * | 9/1992 | Ciolino et al. | 482/111 |
| 5,186,701 | A | * | 2/1993 | Wilkinson | 482/125 |
| 5,261,864 | A | * | 11/1993 | Fitzpatrick | 482/52 |
| 5,269,737 | A | | 12/1993 | Sobotka | |
| 5,279,533 | A | | 1/1994 | Yin et al. | |
| 5,324,243 | A | | 6/1994 | Wilkinson | |
| 5,362,296 | A | | 11/1994 | Wang et al. | |
| 5,476,435 | A | * | 12/1995 | Nimmo | 482/124 |
| 5,484,366 | A | * | 1/1996 | Wilkinson | 482/105 |
| 5,624,360 | A | | 4/1997 | Wilkins | |
| 5,690,594 | A | | 11/1997 | Mankovitz | |
| 5,690,595 | A | * | 11/1997 | Quinones | 482/124 |
| 5,713,821 | A | | 2/1998 | Nissen | |
| 5,743,838 | A | * | 4/1998 | Willis | 482/124 |
| 5,860,897 | A | | 1/1999 | Gilbert et al. | |
| 5,897,470 | A | | 4/1999 | Chen | |
| 5,954,622 | A | * | 9/1999 | Olschansky et al. | 482/123 |
| 6,007,463 | A | * | 12/1999 | Wells et al. | 482/126 |
| 6,007,572 | A | * | 12/1999 | Baldwin | 607/114 |
| 6,099,447 | A | | 8/2000 | Ramsaroop | |
| 6,117,056 | A | * | 9/2000 | Cataldi et al. | 482/121 |
| 6,159,133 | A | | 12/2000 | Shugg | |
| 6,220,994 | B1 | | 4/2001 | Rich | |
| 6,245,001 | B1 | | 6/2001 | Siaperas | |
| 6,287,242 | B1 | * | 9/2001 | Fray | 482/121 |
| 6,461,283 | B1 | * | 10/2002 | Maron | 482/123 |
| 6,500,104 | B1 | * | 12/2002 | Rich | 482/123 |
| 6,588,840 | B1 | * | 7/2003 | Lombardo | 297/228.12 |
| 6,840,894 | B2 | * | 1/2005 | Lerner | 482/124 |
| 6,848,746 | B2 | * | 2/2005 | Gentry | 297/380 |

(Continued)

*Primary Examiner* — Allana Lewin
(74) *Attorney, Agent, or Firm* — Abelman, Frayne & Schwab

(57) ABSTRACT

This exercise device of the present invention is a comfortable, portable, flexible, travel friendly, light weight device that a user can use in a variety of situations or locations, without being confined to a gym or home. It is also practical for a user who is confined to a wheel-chair or a bed, as the user can exercise and stretch while seated and/or lying down. With the exercise device of the present invention, a user has the ability to exercise and/or stretch in a multiple of different ways, working multiple areas of the physique.

15 Claims, 18 Drawing Sheets

U.S. PATENT DOCUMENTS

| | | | | |
|---|---|---|---|---|
| 7,077,792 | B2 | 7/2006 | Nerenberg | |
| 7,137,935 | B2 | 11/2006 | Clarke et al. | |
| 2006/0084556 | A1* | 4/2006 | Payne | 482/121 |
| 2006/0194679 | A1* | 8/2006 | Hatcher | 482/123 |
| 2008/0039301 | A1 | 2/2008 | Halbridge | |
| 2009/0163336 | A1 | 6/2009 | Mueller | |

* cited by examiner

PORTABLE EXERCISE DEVICE

RELATED APPLICATIONS

This application claims the benefit of provisional patent application Ser. No. 61/189,840, filed Aug. 22, 2008 by the present inventor, which is incorporated by reference herein.

BACKGROUND OF THE INVENTION

1. Field of the Invention

This invention relates to a portable exercise device, specifically to a device that is structurally flexible and allows a user to perform various conditioning, strengthening and/or stretching exercises comfortably and conveniently.

2. Description of Related Art

Individuals often find themselves in seated positions for extended periods with little or no opportunity for physical activity. For instance, individuals confined to a wheelchair, power chair, mobility scooter or other seated assistance device are extremely limited in their ability to perform physical activity, as even if they are capable of visiting an exercise facility or using certain equipment, moving to and from their seated position can be arduous.

In addition, individuals who are confided to a seated position in cars, trucks, airplanes, and other motor vehicles or crafts often experience fatigue and circulation issues.

Prior attempts to provide a portable exercise device adaptable to various seating arrangements have been limited. For instance, many devices are clearly not suitable for seating thereon for extended period of time due to lack of comfort.

U.S. Pat. No. 992,272 describes a box-like structure to which a plurality of springs can be attached for performing various exercises. In addition, U.S. Pat. No. 1,623,671 describes a rigid body having a chain attached. Springs or elastic bands are attached at one end to the chain, and the other end has a handle. Notably, there is little consideration to comfort, portability and the ability to have these devices always "at-hand" and ready for use by an individual.

U.S. Pat. No. 5,860,897 describes a relatively rigid molded thermoplastic sheet seat member, which would not be comfortable to an individual for long periods of time, and is also limited in terms of the variety of exercises that can be performed with the device.

U.S. Pat. No. 6,117,056 describes a seat cushion that must be strapped around a chair. A seat cushion is provided, and D-rings are included generally on the strap portion for attachment of elastic members. This device is limited to certain types of seating arrangements.

U.S. Pat. No. 6,500,104 describes a device requiring a rigid frame, and is limited to a set configuration for folding and/or carrying the device.

Therefore, a need exists for a device that allows a user, from a seated position, to comfortably and conveniently perform one or more conditioning, strengthening and/or stretching exercises while overcoming the limitations of the prior art.

SUMMARY OF THE INVENTION

The exercise device of the present invention allow users who may be disabled and may be confined to a wheelchair or bed, to be able to exercise, stretch or perform various types of physiotherapy, from the comfort of their chair or bed. Exercise equipment is typically in a mechanical form and can be bulky, heavy and require space to store when not in use. Some devices even require more than one person to move or set-up. This invention incorporates in certain embodiments a cushion or pillow as the platform from which it functions. None of the above-mentioned prior art incorporates a cushion or pillow as the platform in which it operates.

This exercise device of the present invention is a comfortable, portable, flexible, travel friendly, light weight device that a user can use in a variety of situations or locations, without being confined to a gym or home. It is also practical for a user who is confined to a wheel-chair or a bed, as the user can exercise and stretch while seated and/or lying down. With the exercise device of the present invention, a user has the ability to exercise and/or stretch in a multiple of different ways, working multiple areas of the physique.

Therefore, it is an object of the present invention to provide a device that allows a user, from a seated position, to comfortably and conveniently perform one or more conditioning, strengthening and/or stretching exercises.

It is another object of the present invention to provide such a device that is portable, easily stored in any manner convenient to the user, relatively inexpensive and adaptable to conventional seating arrangements including various types of chairs, benches, and vehicle seats.

It is still another object of the present invention to provide such a device that allows for use thereof without interfering with the individual's activity, such as working (e.g., in an office), operating a vehicle, or relaxing on a seat.

It is yet another object of the present invention to provide such a device that is comfortable for an individual to sit thereon for extended periods of time without the need to remove and store the device.

BRIEF DESCRIPTION OF THE DRAWINGS

The invention will be described in further detail below and with reference to the attached drawings in which the same or similar elements are referred to by the same number, and where.

DETAILED DESCRIPTION OF THE INVENTION

Figure 1:
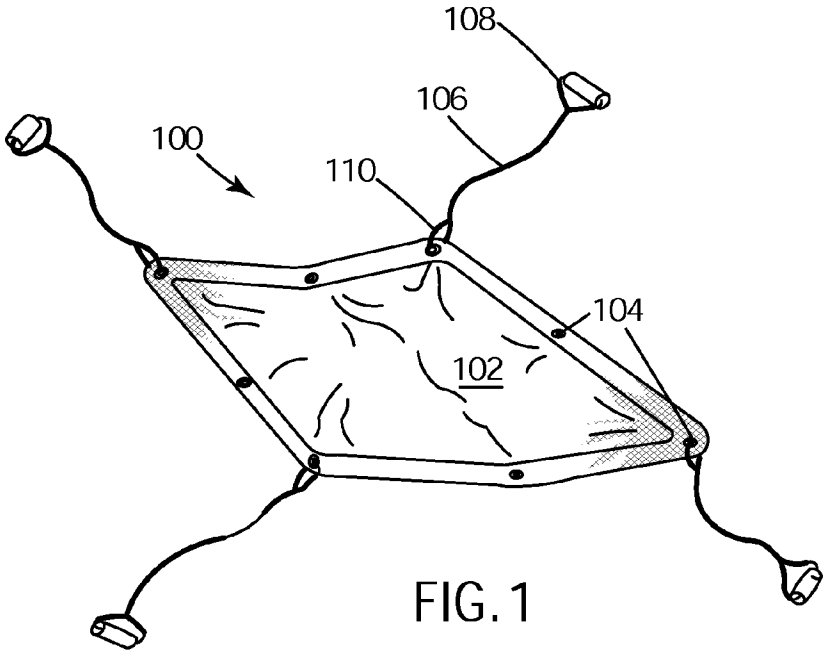
FIG. 1 is a perspective view of the exercise device of the present invention.

Referring now to FIG. 1, a perspective view of a portable exercise device 100 of the present invention is shown. The exercise device 100 includes a flexible base member 102 that is configured and dimensioned for placement under the buttocks and/or behind the back of an individual. The exercise device 100 can be used with any type of conventional seat, including but not limited to a home or office chair with or without a back, having cushioned or not cushioned; an automobile seat; an airplane seat; a seat on a boat or other seafaring vessel; a bench; a sofa; a bed or other surface upon which an individual can lay down. Accordingly, in a preferred embodiment, the flexible base member 102 can be generally square having sides of about 14 inches to about 22 inches, a rectangle having sides of about 10 inches to about 18 inches by about 14 inches to about 22 inches, an ellipse having a major diameter of about 14 inches to about 22 inches and minor diameter of about 10 inches to about 18 inches, a circle having a diameter of about 14 inches to about 22 inches, or any other suitable shape having similar area dimensions. However, the exercise device of the present invention can be dimensioned to accommodate a range of users, from children to large adults, and also to accommodate multiple users at once.

Figure 2:
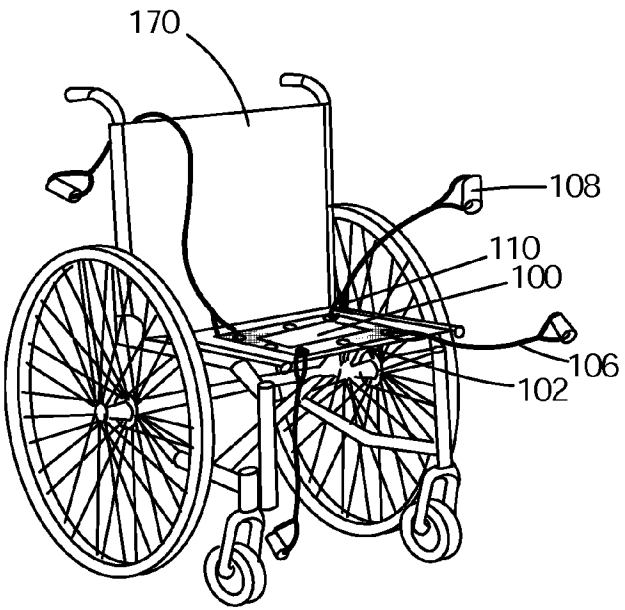
FIG. 2 is a perspective view of the exercise device of the present invention arranged on a wheelchair.

As shown in FIG. 2, the exercise device 100 can be placed on the seat of a conventional wheelchair 170, for instance, allowing an individual having a physical handicap to comfortably, conveniently and effectively perform various conditioning, strengthening and/or stretching exercises. The flexible base member 102 is formed of suitable materials and has a configuration that allows the user to sit or lie upon the exercise device 100 for extended periods of time, i.e., even when not performing exercises, while remaining as comfortable, or even more comfortable (due to additional padding and/or cushioning), as they would feel while in the original seat.

The flexible base member 102 generally includes a plurality of attachment points 104 proximate to its peripheral edges. Further, a plurality of resistance members 106 are provided having a handle end 108 and an attachment end 110. The attachment end 110 is configured and dimensioned with removable attachment to the attachment point 104. This allows a user to remove the resistance member 106 from a particular attachment point 102 and relocate it to another attachment point 102, for instance, to provide a different angle and/or orientation suitable for different conditioning, strengthening and/or stretching exercises. The handle end can include a closes handle, an open handle, a loop (e.g., looped portion of the resistance member), a strap (e.g., an ankle or wrist strap), a ball structure, or other suitable structure allowing a user to perform a suitable conditioning, strengthening and/or stretching exercise.

Figure 3A:
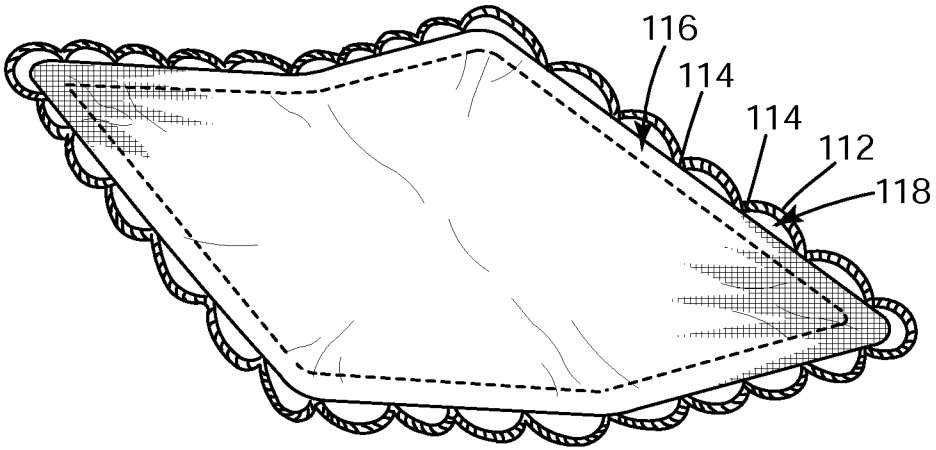
FIGS. 3A and 3B show an embodiment of the present invention using a cord or rope around the periphery as a variety of attachment points.
Figure 3B:
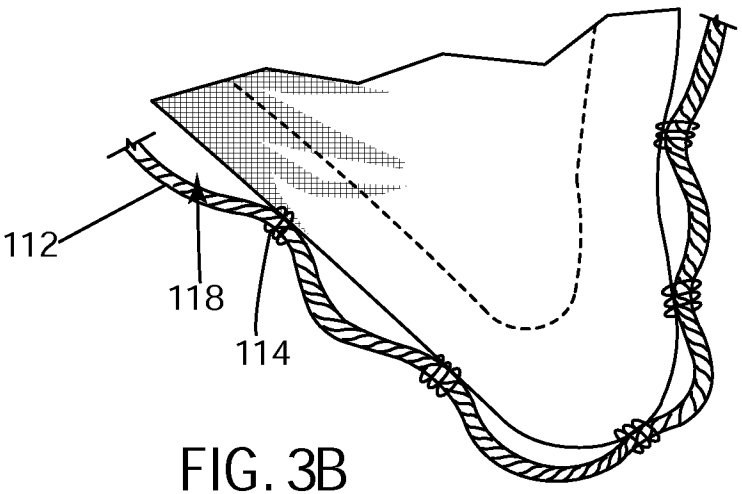

The attachment point can include various structures, including but not limited to a reinforced aperture reinforced by stitching or some other member, such as a grommet. In additional embodiments, a plurality of attachment points can be formed from a single elongated member that spans proximate to or on at least a portion of the peripheral edge of the flexible base member 102. For instance, as shown in FIG. 3A, a cord, rope, strap webbing or other elongated flexible member 112 can be attached at various points 114 (as detailed in FIG. 3B) to the peripheral edge 116 of the flexible base member 102 e.g., in a manner similar to a bolt rope known in the nautical industry that is sewn on the edge of sail. Accordingly, loops 118 are formed that are suitable for receiving the attachment ends of the resistance members.

Figure 4C:
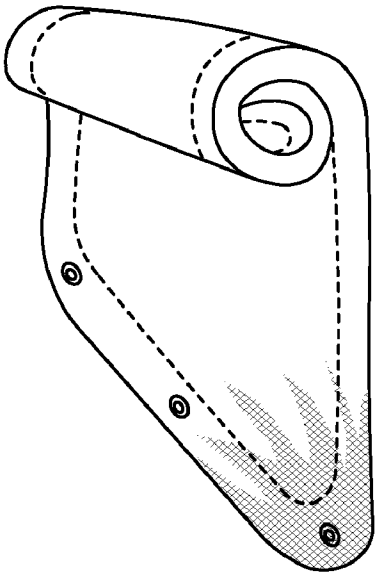
FIGS. 4A-4C show various ways in which the exercise device of the present invention can be compacted for storage and portability.
Figure 4B:
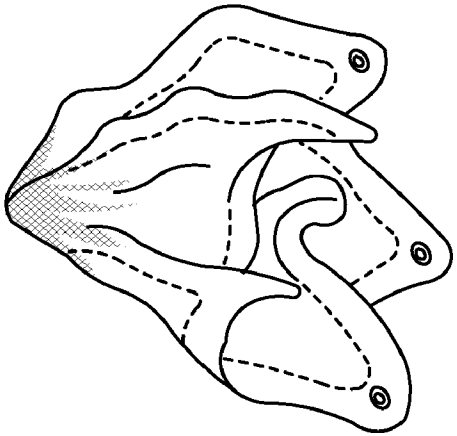
Figure 4A:
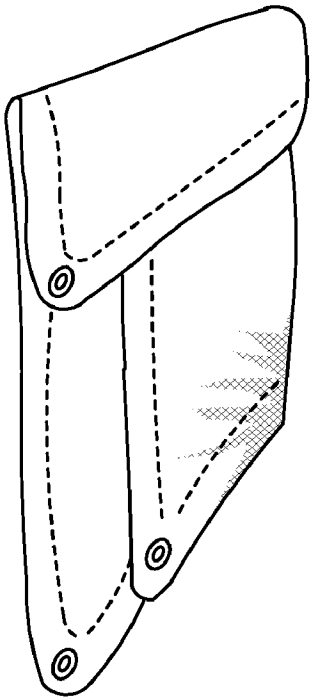

Advantageously, the exercise device 100 of the present invention allows a user to fold (FIG. 4A), crumple (FIG. 4B), roll (FIG. 4C) or otherwise compact the device for extreme portability and ease and flexibility of storage. FIGS. 4A-4C show various compactions of the exercise device of the present invention. Note that while these illustrations show the portable exercise device compacted without the resistance members attached thereto, it is to be understood that the device can also be compacted with one or more resistance members attached thereto for convenience and portability. FIG. 4A shows the portable exercise device of the present invention folded. FIG. 4B shows the portable exercise device of the present invention crumpled. FIG. 4C shows the portable exercise device of the present invention rolled. These various compactions are possible due to the lack of any rigid support members in the portable exercise device of the present invention, in contrast to conventional exercise devices intended for use with a chair or seat.

In an alternative embodiment, one or more resistance members 106 can be provided that are permanently or semi-permanently attached to a region of the flexible base member proximate its peripheral edge. The attachment can be manufactured in this manner, or, for instance, provided as a kit to a health care provider (such as a physician, a nurse, a physical therapist, an occupational therapist) or a physical trainer whereby the provider or trainer can customize the position of attachment and thereby control the angle and/or orientation of the resistance member, as well as provide any desired level of resistance (e.g., by selecting a suitable resistance member and/or adjusting the length of the resistance member, i.e., the location on the resistance member that is fixed to the flexible base member 102.) This can be preferred, for instance, for situations in which an individual has a particular desire or need to perform certain conditioning, strengthening and/or stretching exercises that are effectively conducted at a particular angle and/or orientation that is fixed. In certain embodiments of this alternative, there is no need for a plurality of attachment points such as attachment points 102, as the resistance member(s) 106 can be fixed in place by stitching, riveting or otherwise permanently or semi-permanently attaching directly to a region of the flexible base member proximate its peripheral edge. In other embodiments, the resistance member(s) 106 can be fixed in place by looping the attachment end 110 through an attachment point 102, and stitching, riveting or otherwise permanently or semi-permanently attaching a end of the resistance member 104 to a portion of itself, i.e., looping the distal end through and attaching the end to a portion some distance therefrom. The stitching, riveting or other form of permanent or semi-permanent attachment, either directly to the flexible base member 102, or to a portion of itself, is of suitable strength to withstand repeated use of the resistance member(s) 106.

Although the device is shown and described as including a plurality of attachment points 104 and a plurality of resistance members 106, it is contemplated that certain embodiments of the present invention can benefit from using a single resistance member 106, depending on the particular needs or desires of the user.

Figure 5:
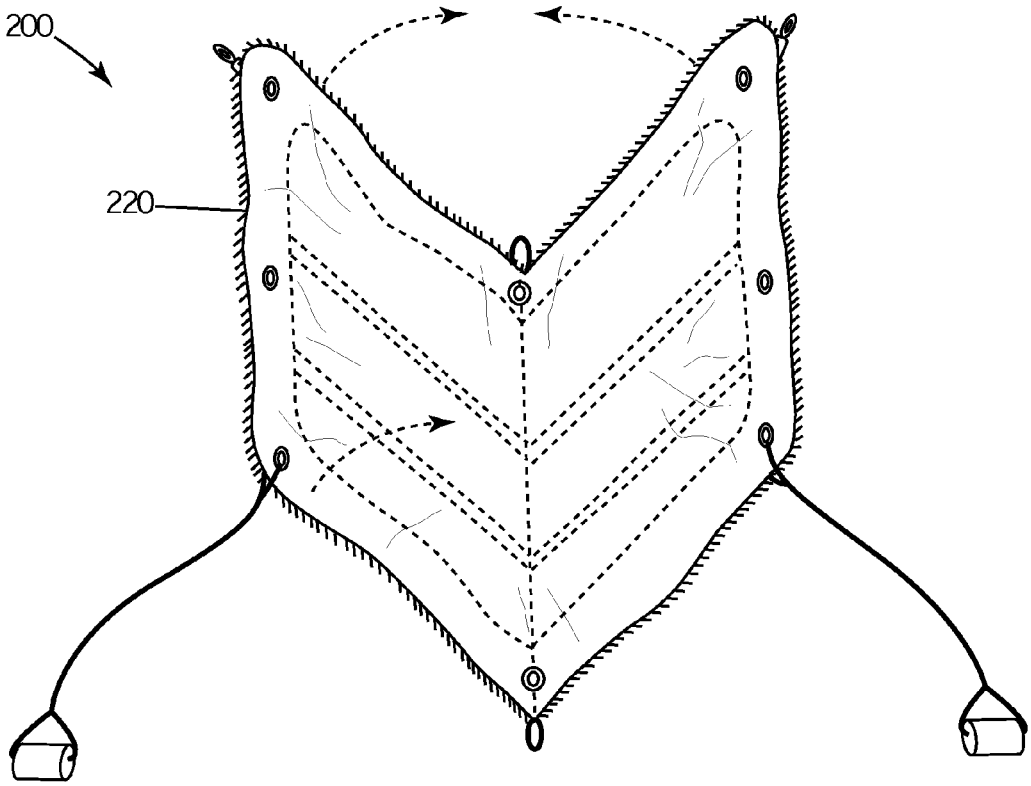
FIG. 5 shows an embodiment of the exercise device of the present invention suitable for conversion into a satchel or bag.

FIG. 5 shows another embodiment of a portable exercise device 200 of the present invention including a zipper 220 around its periphery. This allows one to fold and zipper the portable exercise device 200 (e.g., after removal of the resistance members) and store items, including removed resistance members, extra resistance members, handles and attachment structures, or other items therein. In an alternative embodiment, an elongated member (similar to that of FIGS. 3A and 3B) having a plurality of points attached to the flexible base member inside of its peripheral edge can also be provided, and the zipper provided at the outside periphery. Accordingly, the resistance members need not be removed to enclose the exercise device. In further alternative embodiments, a zipper can be provided inside of the circumference of the attachment points, e.g., grommets or an elongated member forming loops, such that when the exercise device is folded and zippered up, the resistance members remain on the outside, and can for instance, be tucked into an open end of the bag created by the zipped-up exercise device.

Figure 6:
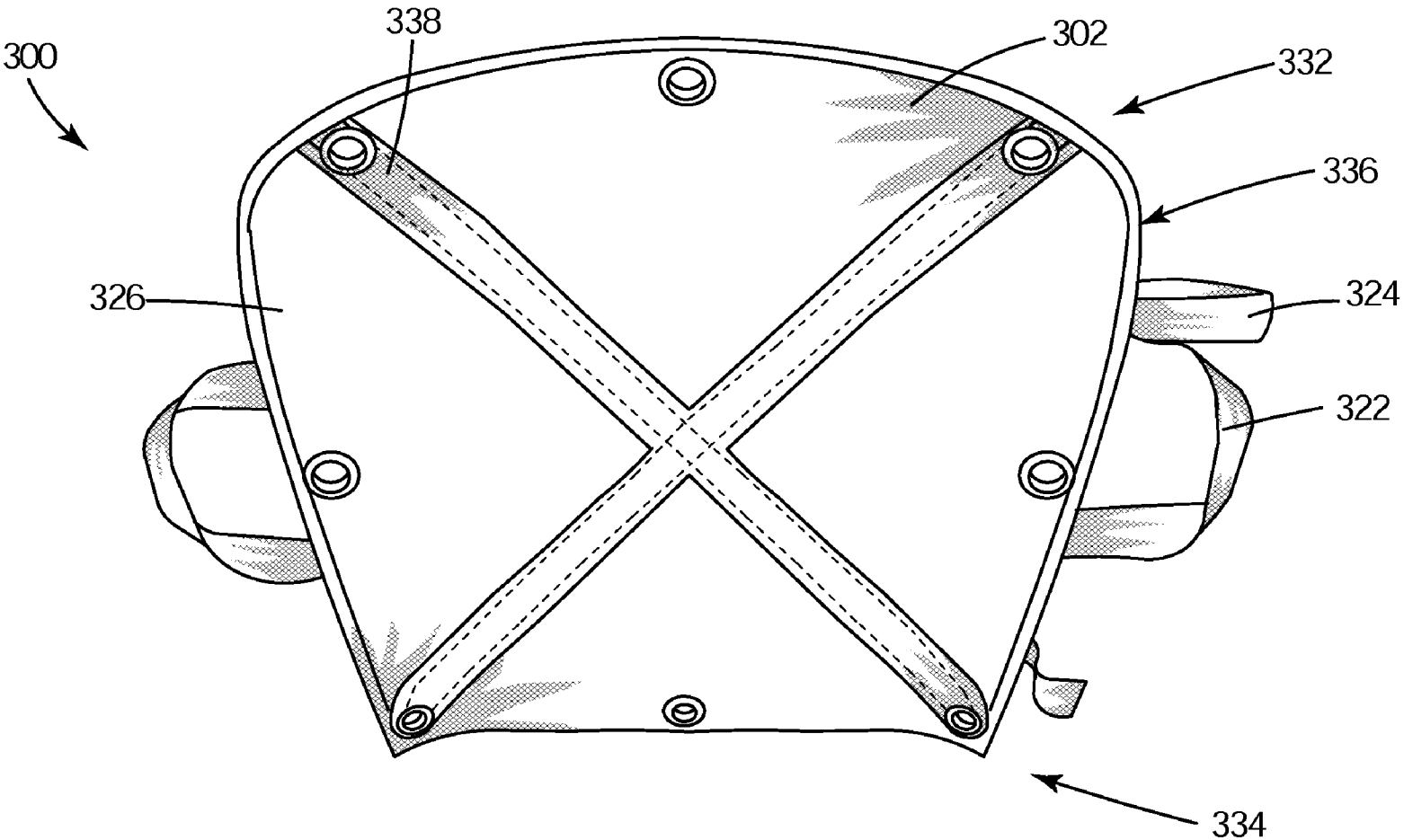
FIGS. 6 and 7 shows further embodiments of the exercise device of the present invention suitable for conversion into a satchel or bag.

FIG. 6 shows still another embodiment of a portable exercise device 300 of the present invention including the flexible base member 302 generally having a shape symmetrical along its vertical axis (as oriented in FIG. 6) with a pair of curved corners 332 and a pair of obtuse-angled corners 334. The symmetrical sides 336 each include handle portions 322 (for instance, which can be formed of a single strap member stitched along the back as shown by phantom lines.). In addition, to facilitate closure of the portable exercise device 300, a complementary set of hook and loop fasteners 324, 326 are provided (with the loop portions 326 shown in phantom lines as they are on the backside of the flexible base member 302). Accordingly, the portable exercise device 300 can be folded and the complementary hook and loop fasteners 324, 326 attached thereby providing convenience of portability and reduced dimension. Additional reinforcing webbing 338 is stitched, e.g., diagonally across the flexible base member 302, to provide additional reinforcement.

In certain embodiments the flexible base member 302 of the portable exercise device 300 is formed of a material or laminar material without padding therein, thus according the ability to fold, crumple, or roll to a very small overall volume to facilitate portability.

Figure 7:
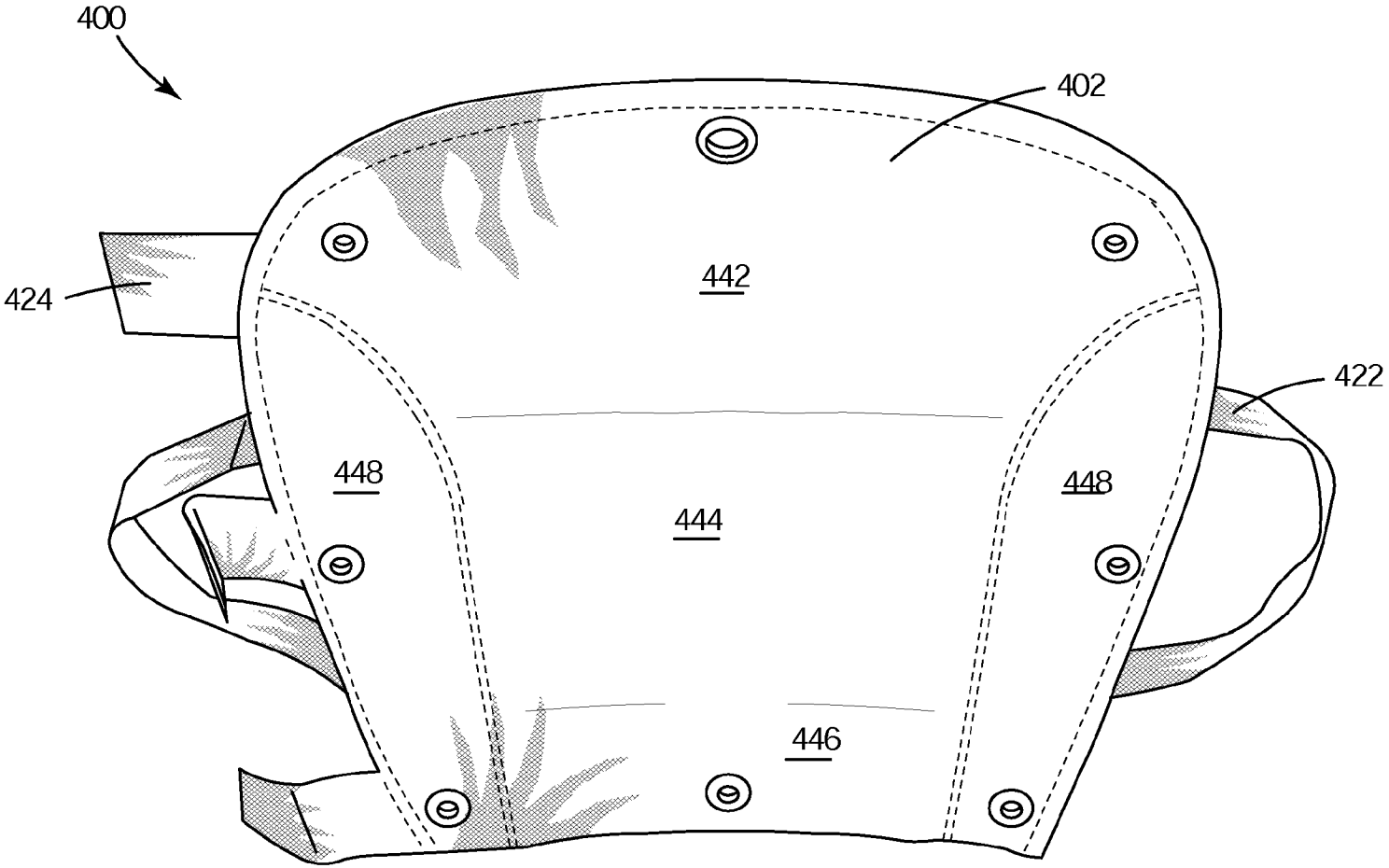

FIG. 7 shows a portable exercise device 400 similar to portable exercise device 300, with the exception that the device is padded. In addition, since the padding is formed by separate stitched regions 442, 444, 446 and 448 (two opposing regions 448), the need for the reinforcement webbing is obviated. The separate regions 442, 444, 446 and 448 prevent the passing or stuffing from agglomerating to one area in the device.

Figure 8:
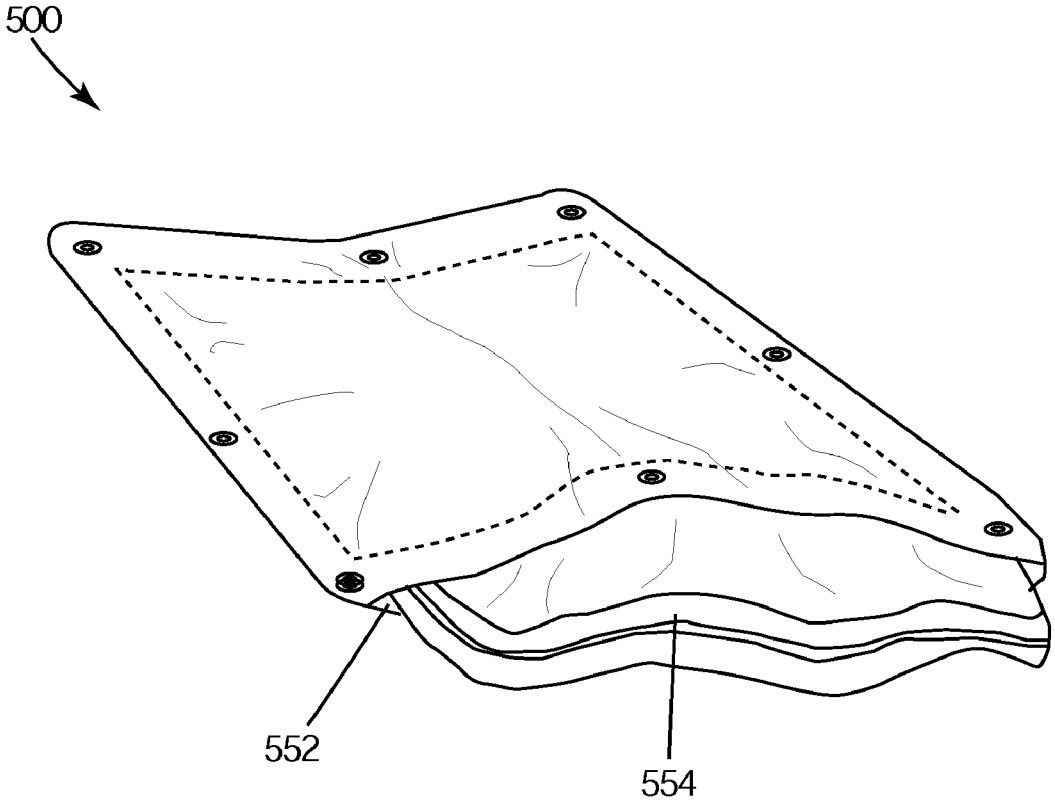
FIG. 8 shows an embodiment of the exercise device of the present invention in the form of a pocket for holding a removable cushion or other similarly sized item.

FIG. 8 shows a portable exercise device 500 having an open end 552, similar to a pillowcase, thereby allowing one to incorporate or remove an insert 554, such as a cushion or gel pack, from the interior. In addition, insert 554 can be a heating pad, a cooling pad, or other therapeutic member that is electrical or chemically activated. Further, in certain embodiments, a vibrating insert 554 can be provided, for instance, with massaging functionality, to enhance the therapeutic impact of the device 500.

Figure 9:
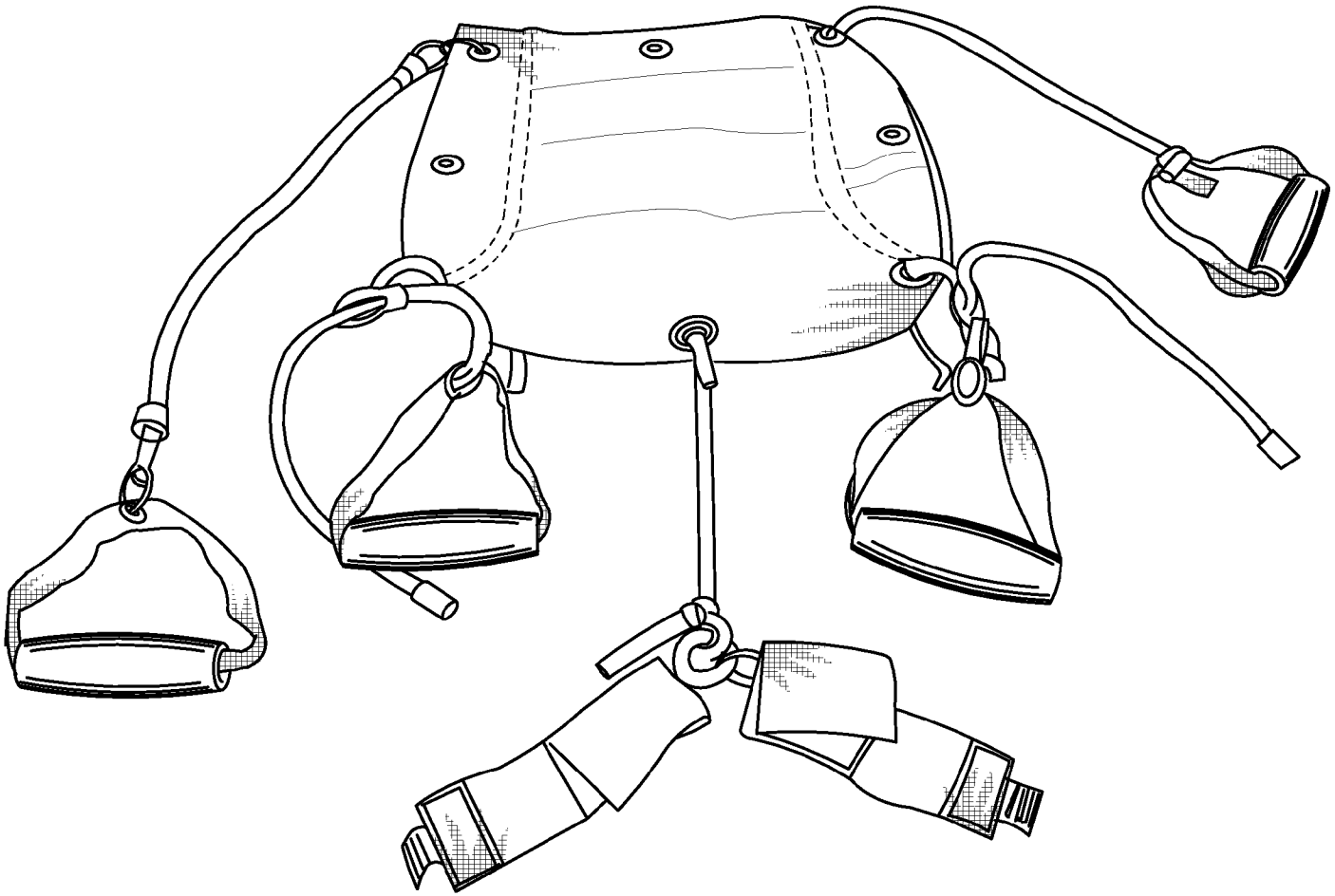
FIG. 9 shows a complete assembly of exercise device of the present invention including various resistance members.

FIG. 9 shows a portable exercise device similar to the portable exercise device 400 including a set of resistance members 406 towards the posterior having handles, i.e., attached to attachment points at the rear of the device, another set of resistance members 406 towards the anterior having handles, i.e., attached to attachment points at the front of the device, and a resistance member 406 having ankle straps. Note that the resistance members 406 towards the anterior are of shorter length. This is suitable, for instance, to provide a shorter range of motion for exercises such as arm curls, whereas the longer resistance members 406 are suitable for shoulder presses. In addition, a user can attach the ankle straps to their ankles and perform various leg exercises using the device 400.

Figures 10A, 10B:
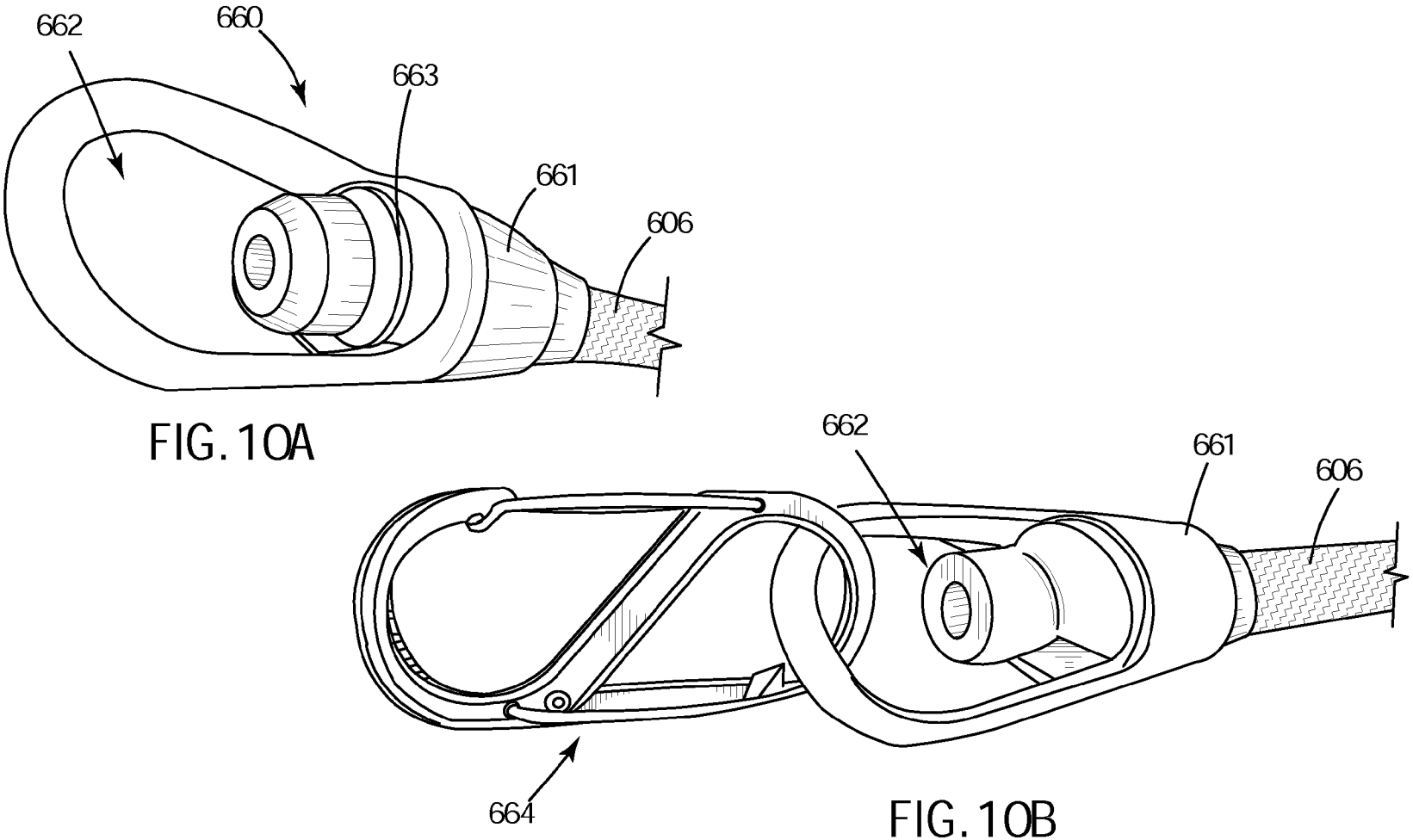
FIGS. 10A-10B show an attachment end structure in the form of an eyelet.

FIG. 10A is an embodiment of a structure 660 suitable as an attachment end of a resistance member 606. Structure 660 includes a receiving end sleeve 661 configured for receiving an end of the resistance member 606, which is prevented from slipping through the structure 660 by a suitable knot, or as shown, a spherical structure 663 embedded within a hollow center of a resistance member in the form of tubing, or other suitable structure to provide a dimension greater than the receiving end aperture of the structure 660. For instance, a suitable arrangement is provided on a product available for retail purchase and marketed under the brand name "Gold's Gym" resistance tubes. In addition, an eyelet 662 is provided that extends beyond the end of the resistance member 606. Referring to FIG. 10B, a suitable detachable clip 664, such as a spring-loaded S-clip, can be used to secure the resistance member 606 to an attachment point associated with the flexible base member, e.g., an attachment point 104 in the form of a reinforced aperture, or a loop 118 associated with an elongated member that spans proximate to or on at least a portion of the peripheral edge of the flexible base member. In addition, the detachable clip 664 and structure 660 can also be associated with a handle used on the handle end 108 of the resistance member 106. Further, a structure 660 and associated detachable clip 664 can be provided on both ends of the resistance member 606.

Figure 11:
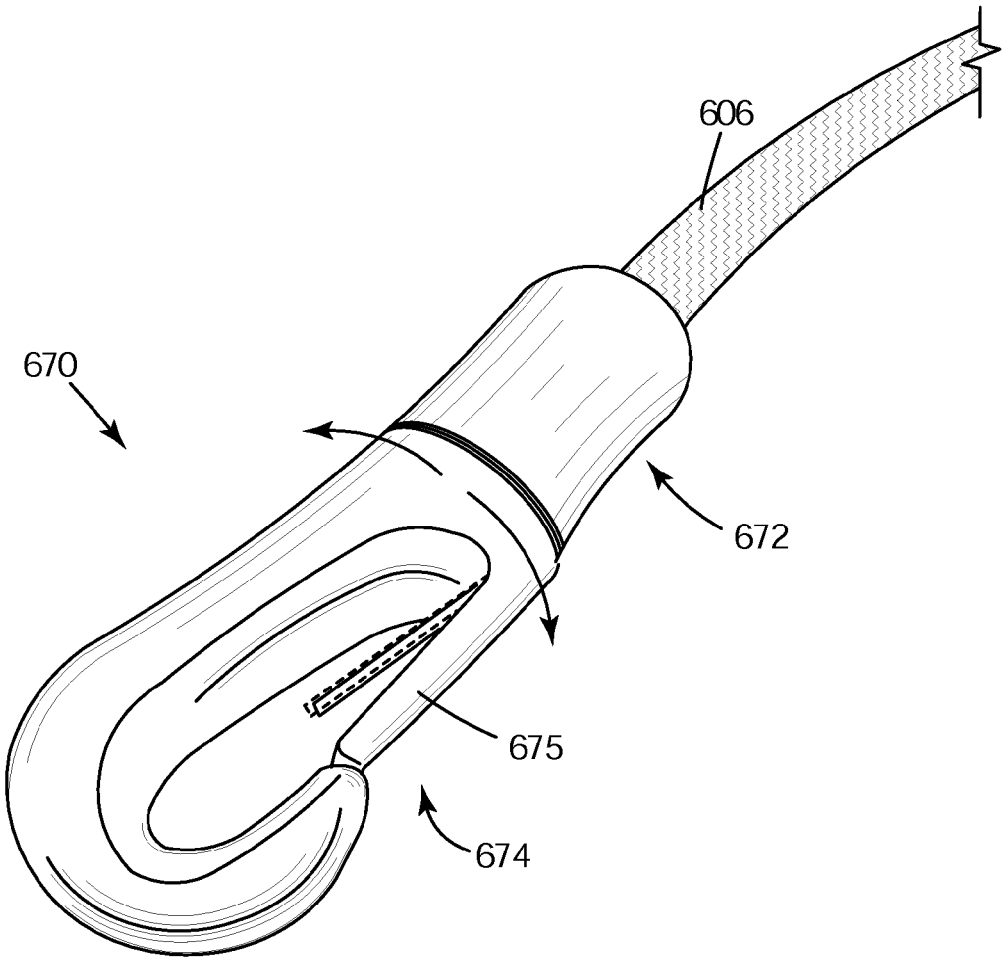
FIG. 11 shows an attachment end structure in the form of an hook.

FIG. 11 shows another embodiment of a structure suitable as an attachment end of a resistance member 606 in the form of a spring clip structure 670. Spring clip structure 670 includes a clipping end 674 and a receiving end 672 that can be permanently affixed to an end of the resistance member 606. The clipping end 674 can be rotatable with respect to the receiving end 672. The clipping end 674 can be used to secure the resistance member 606 to an attachment point associated with the flexible base member, e.g., an attachment point 104 in the form of a reinforced aperture, or a loop 118 associated with an elongated member that spans proximate to or on at least a portion of the peripheral edge of the flexible base member, by deflection of a clip jaw 675 (as shown by broken lines). In addition, the clipping end 674 can also be associated with a handle used on the handle end 108 of the resistance member 106. Further, a spring clip structure 670 can be provided on both ends of the resistance member 606.

Figure 12A:
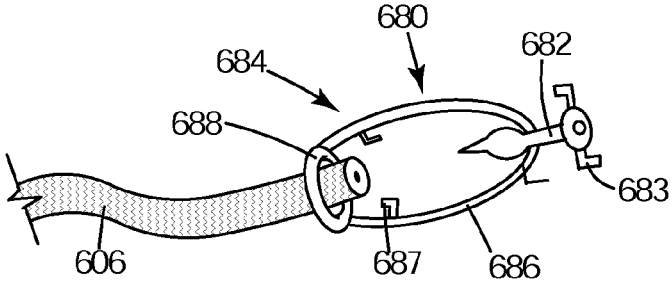
FIGS. 12A-12D show an attachment end structure in the form of an eyelet allowing for customization of the length of the resistance member.
Figure 12B:
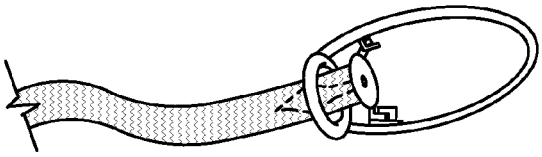

FIGS. 12A-12D depict another embodiment of an apparatus 680 for providing an eyelet at the end of a resistance member 606. Apparatus 680 includes a twist lock ball skewer member 682 and an eyelet member 684. Eyelet member 684 includes an eyelet region 686, and an aperture 688 for receiving the end of the resistance member 606. The aperture 688 fits over the end of the resistance member 606. The twist lock ball skewer member 682 is inserted and twisted into the open tube end of the resistance member 606, as shown in FIG. 12B. The bulbous portion of the twist lock ball skewer member 682, having a diameter greater than that of the aperture 688, maintains the apparatus 680 in the end of the resistance member 606, along with frictional forces of the tube material against the inside surface f the aperture 688, and the locking force created by engagement of the locking structures 683 on the end of the twist lock ball skewer member 682 and locking structures 687 on the loop forming the eyelet region 686. The locking structures 687 are positioned and dimensioned as to allow the locking structures 683 to engage them when the twist lock ball skewer member 682 is inserted to a suitable depth in the end of the resistance member 606.

Figure 12C:
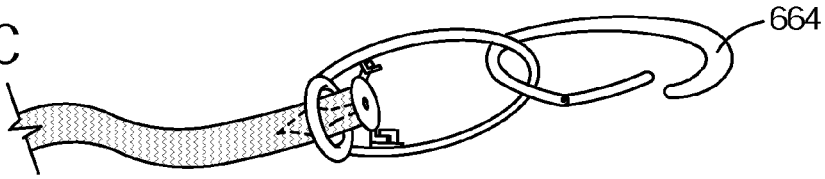
Figure 12D:
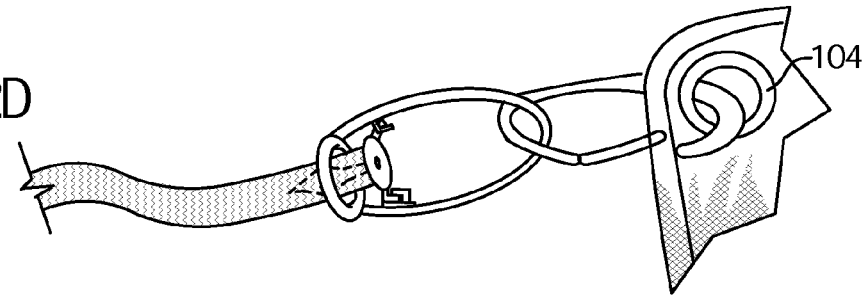

Advantageously, the resistance member can be provided to the user in the form of a roll, and the user can customize the length thereof and attached the apparatus 680 to provide an eyelet. A suitable detachable clip 664, such as a spring-loaded carabiner clip as shown in FIG. 12C, is provided and can be used to secure the resistance member 606 to an attachment point associated with the flexible base member, e.g., an attachment point 104 in the form of a reinforced aperture as shown in FIG. 12D, or a loop 118 associated with an elongated member that spans proximate to or on at least a portion of the peripheral edge of the flexible base member. In addition, the detachable clip 664 and structure 680 can also be associated with a handle used on the handle end 108 of the resistance member 106. Further, a structure 680 and associated detachable clip 664 can be provided on both ends of the resistance member 606.

Figure 13:
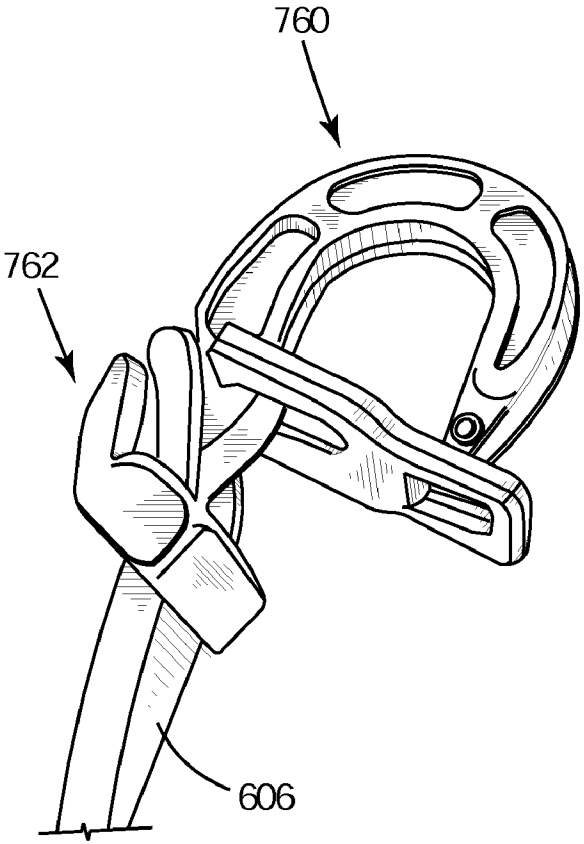

FIG. 13 shows another embodiment of a structure 760 suitable for use with a resistance member 606. In this embodiment, structure 760 is in the form of a locking hook having a portion 762 for passing therethrough a resistance member 606, such as a bungee cord, and both ends are free (not shown). The pair of free ends can be connected to a single handle or other structure on end 108 (e.g., ball, ankle strap, etc.) thereby providing double the resistance as compared to a single bungee cord of the same construction and the same length. Alternatively, each free end of the resistance member 706 can be attached to a separate handle or other structure on end 108 (e.g., ball, ankle strap, etc.), allowing a user to perform dual-limb exercises from the same attachment point.

Figure 14:
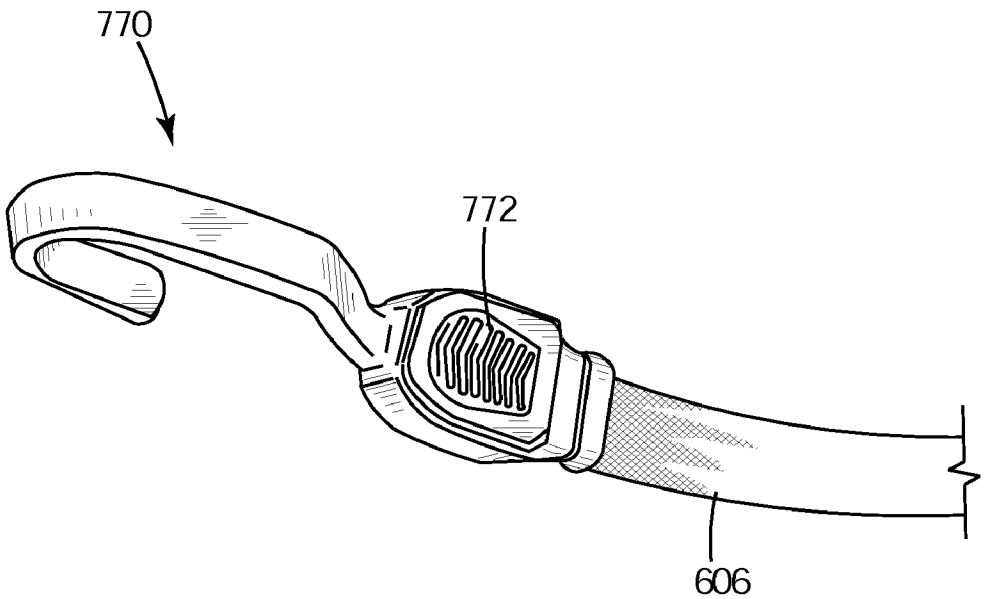
FIGS. 13 and 14 show attachment end structures in the form of various hooks.

FIG. 14 shows another embodiment of a structure 770 suitable for use with a the end of a resistance member 606. In this embodiment, structure 770 is in the form of an open hook having a neck 772 in which the resistance member 606 is permanently secured. In this embodiment, the resistance member 606 is in the form of a bungee cord having a rectangular cross section.

Figure 15:
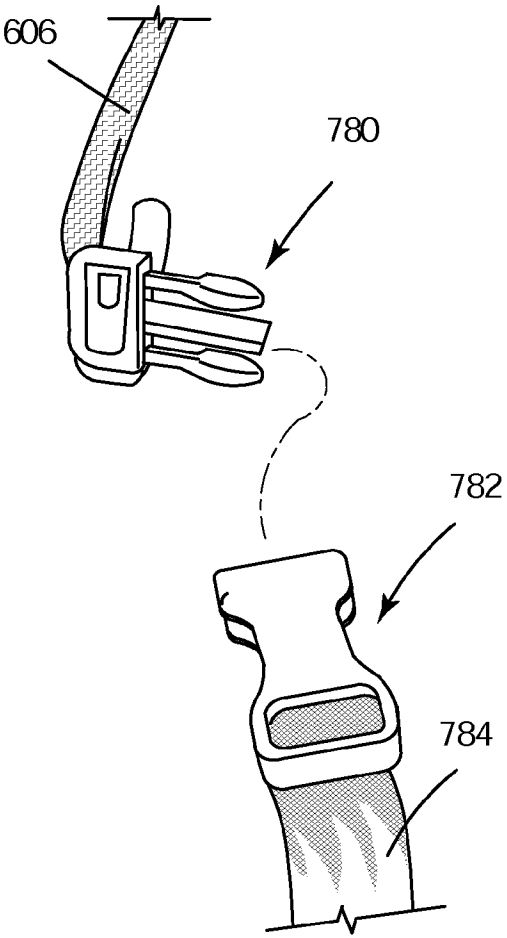
FIG. 15 shows an attachment end structure in the form of an buckle.

FIG. 15 shows another embodiment of a structure 780 suitable for use with a resistance member 606. In this embodiment, structure 780 is in the form of a snap-fit buckle that attaches to a corresponding receiving buckle portion 782 that is connected to an attachment point 104 (not shown) via a strap member 784.

Figure 16:
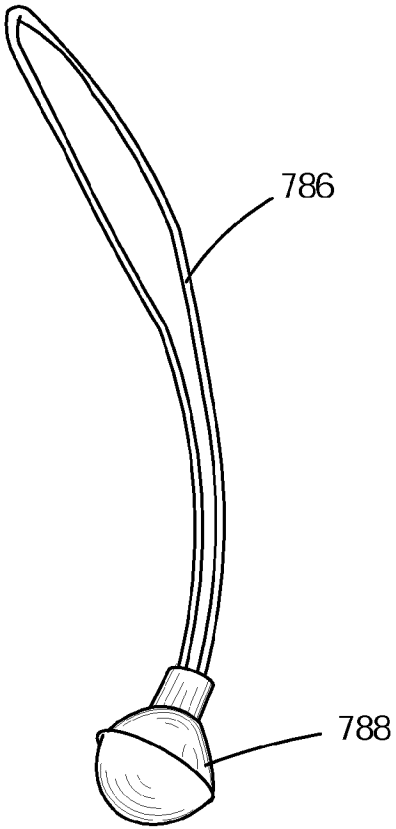
FIG. 16 shows an attachment end structure or a resistance member in the form of an extensible member and a ball structure.

FIG. 16 shows another embodiment of a member that can be used as the resistance member itself, or to create a loop that allows attachment of a separate resistance member. In one embodiment, the flexible resistance loop 786 can be passed through an attachment point 104 in the form of an aperture, wherein the ball portion 788 serves as a stop against the aperture (e.g., a grommet that reinforces the aperture). In another embodiment, the loop portion 786 can be passed through the aperture that comprises an attachment point 104, and the ball portion 788 passed through the loop, wherein the ball portion 788 is suitably dimensioned to serve as the handle end 108 for gripping by a user to perform various exercises.

Figures 17A, 17B, 17C:
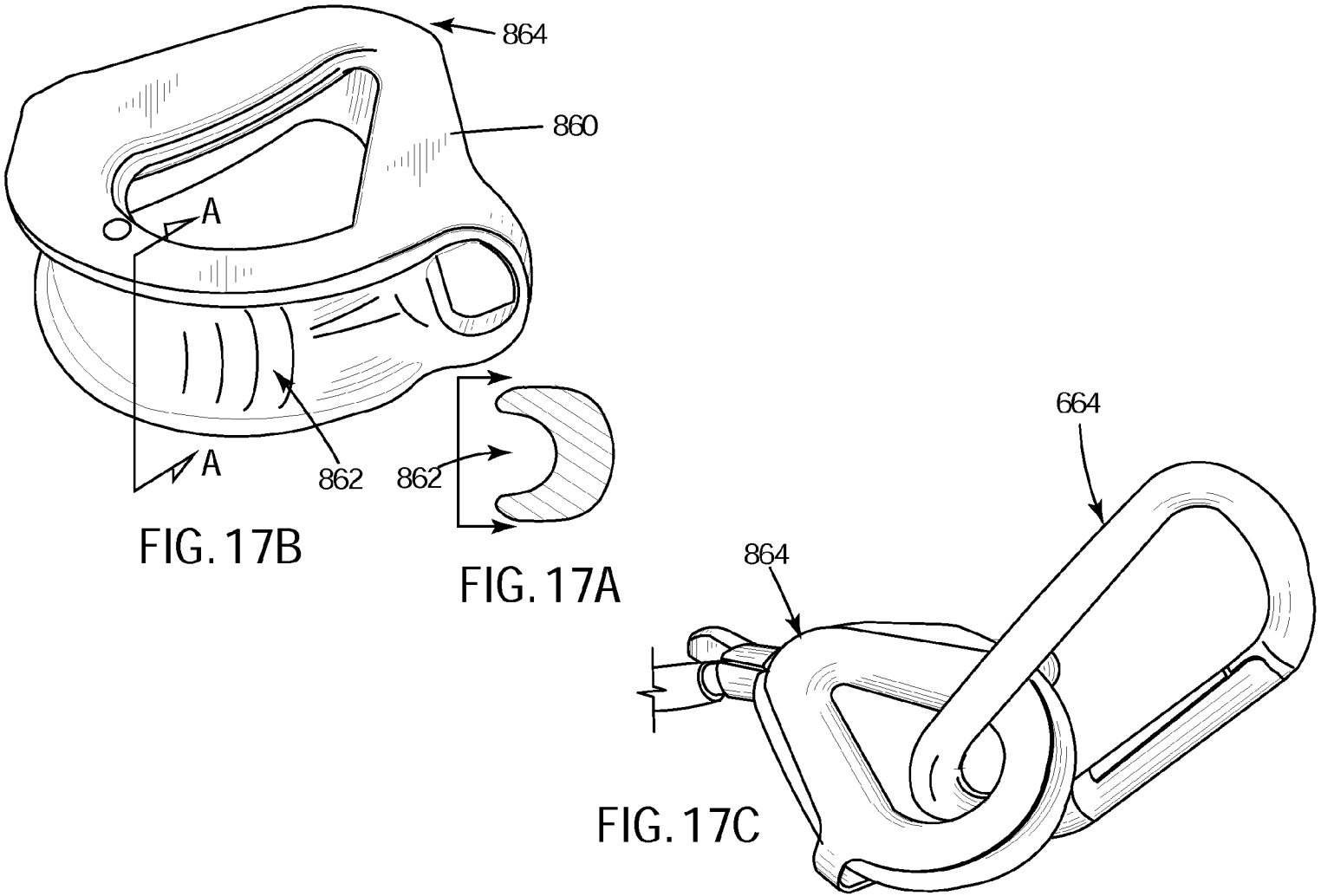
FIGS. 17A-17C show an eyelet for an attachment end structure formed of a rope thimble.

FIGS. 17A, 17B and 17C show another embodiment of a structure 860 suitable for facilitating attachment of a resistance member 606. Structure 860 is generally in the form of a thimble used to create a loop end on a rope or other similar structure. As shown in FIG. 17A, the cross-section provides a generally concave groove 862 within which the resistance member 606 is seated. The resistance member 606 passes through the groove 862 and is attached to itself at the back end 864 of the thimble structure 860, and seized.

A suitable detachable clip 664, such as a spring-loaded carabiner clip as shown in FIG. 17C, is provided and can be used to secure the resistance member 606 to an attachment point associated with the flexible base member, e.g., an attachment point 104 in the form of a reinforced aperture or a loop 118 associated with an elongated member that spans proximate to or on at least a portion of the peripheral edge of the flexible base member. In addition, the detachable clip 664 and structure 880 can also be associated with a handle used on the handle end 108 of the resistance member 106. Further, a structure 880 and associated detachable clip 664 can be provided on both ends of the resistance member 606.

Figure 18A:
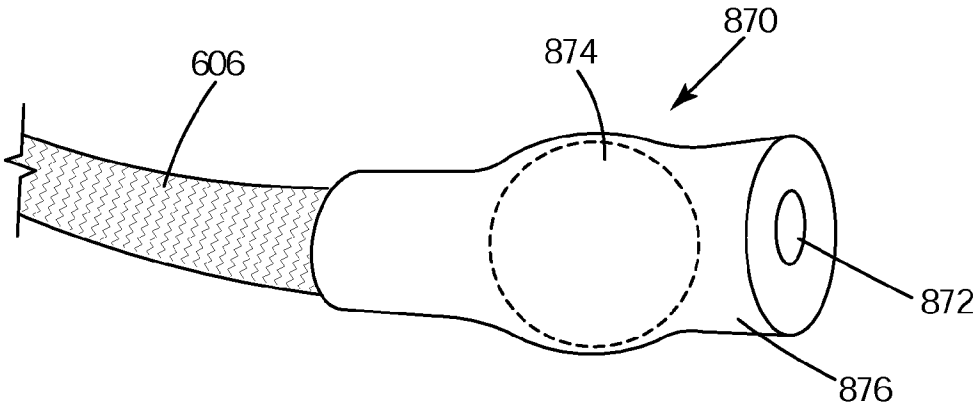
FIGS. 18A-18B show a terminal pea structure and its use to secure a handle to the resistance member.

Referring to FIG. 18A, a terminal end of a resistance member 606, for instance in the form of a resilient tube can be provided with a bulbous pea portion 870. A generally spherical ball 874 (shown in broken lines) is inserted into the hollow end 872 of the resistance member 606. This can be accomplished using machinery known to those skilled in the art. A reinforcing portion 876 is provided, which can be a separate piece of tubing, or the end of the resistance member 606 rolled back over itself. By inserting the opposing end of the resistance member 606 through a suitable terminal eyelet, for instance, as shown in FIG. 10A, a ring can be formed which can be a joint for attachment to the attachment point 104 via a suitable detachable structure such as a carabiner clip or an S-clip.

Figure 18B:
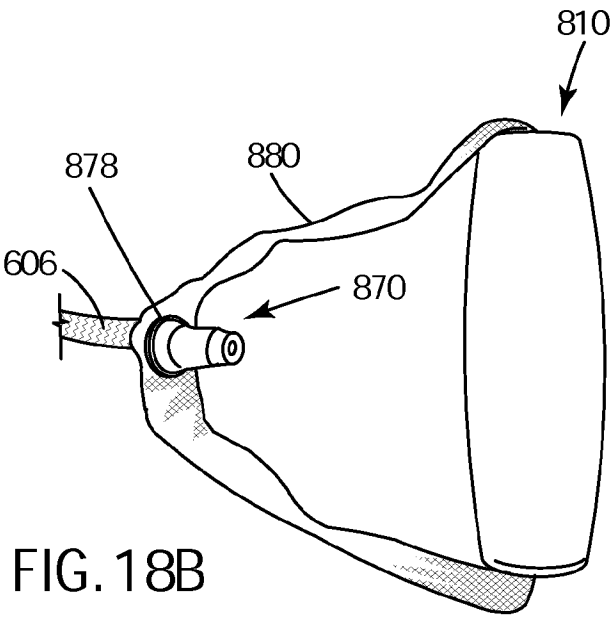

Alternatively, or in addition, as shown in FIG. 18B, a handle 810 can be provided with a suitable aperture 878 on a strap 880 that passed through the handle 810, and the resistance tube 606 having the bulbous pea portion 870 is inserted therein to hold the handle 810 in place.

Figure 19A:
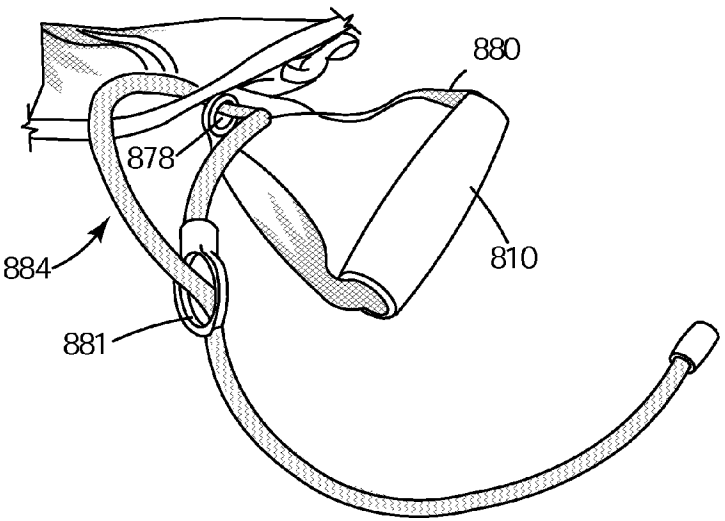
FIGS. 19A-19C show a loop formed with an end of the resistance member with by use of a locking structure.
Figure 19B:
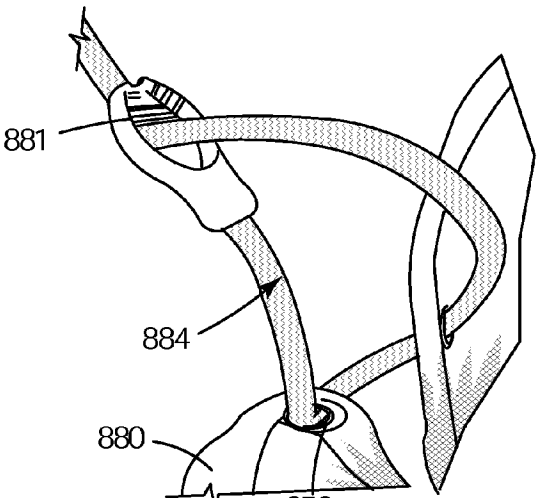
Figure 19C:
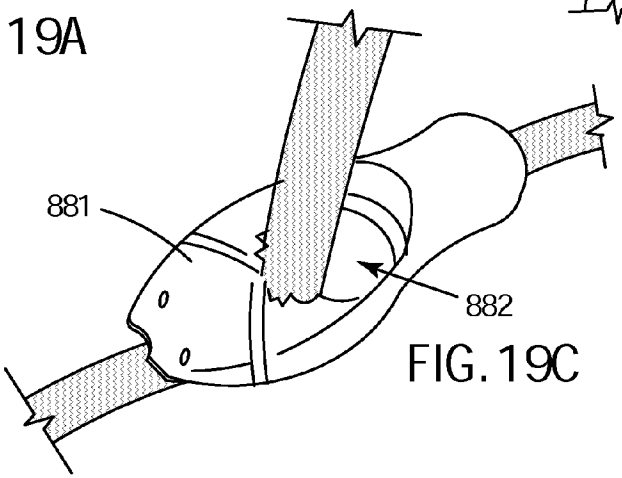

In another embodiment, and referring now to FIGS. 19A-19C, a locking device 881 is provided to hold the resistance member in place. Locking device 881 is known as associated with various bungee cords, such as those commercially available under the name Progrip™ Cargo Control Stretch Lock, and include the locking device at a terminal end of a bungee cord. The free end is passed through the center aperture 882 of the locking device 881, and locked into place in a narrow region that provides a friction fit and secures the loop 884. The loop can pass through an attachment point on the flexible base member and also an aperture on a handle structure, for instance, similar to aperture 878 on the strap 880 associated with handle 810.

Figure 20B:
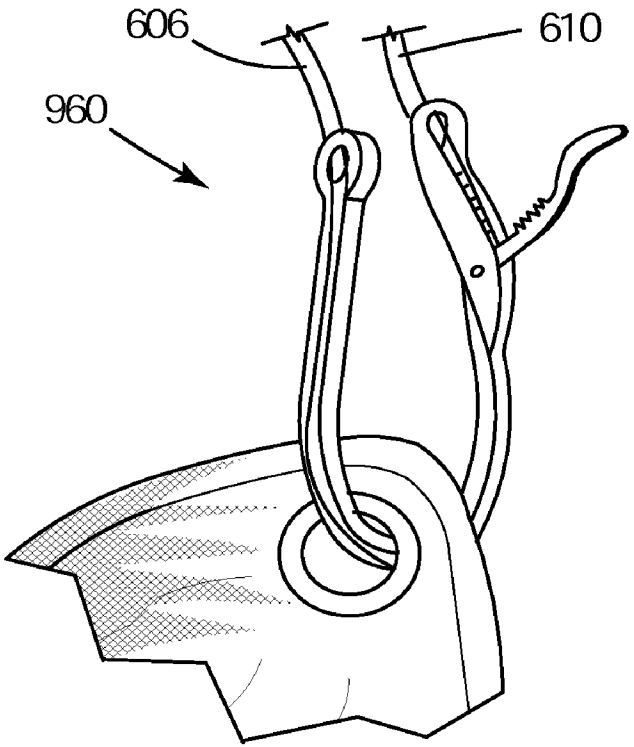
FIGS. 20A-20B show a hook for an attachment end structure formed of a rope thimble including a lever locking portion.
Figure 20A:
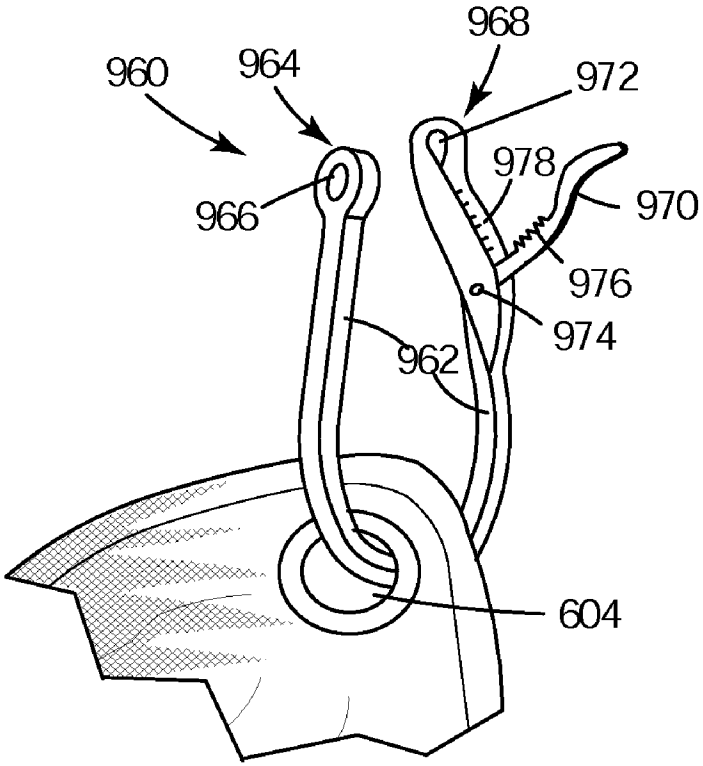
Figure 21A:
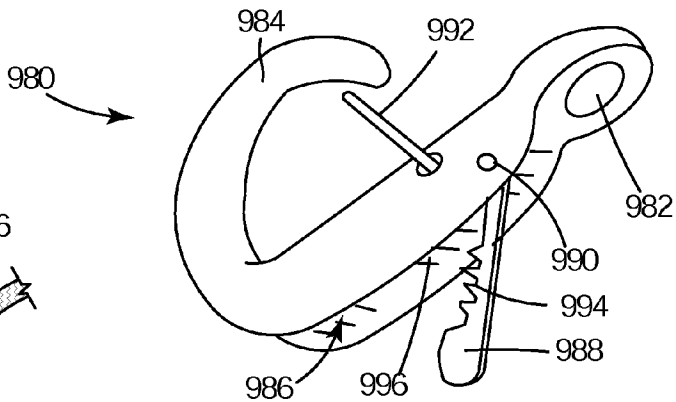
FIGS. 21A-21C show another embodiment of a hook for an attachment end structure formed of a rope thimble including a lever locking portion
Figure 21B:
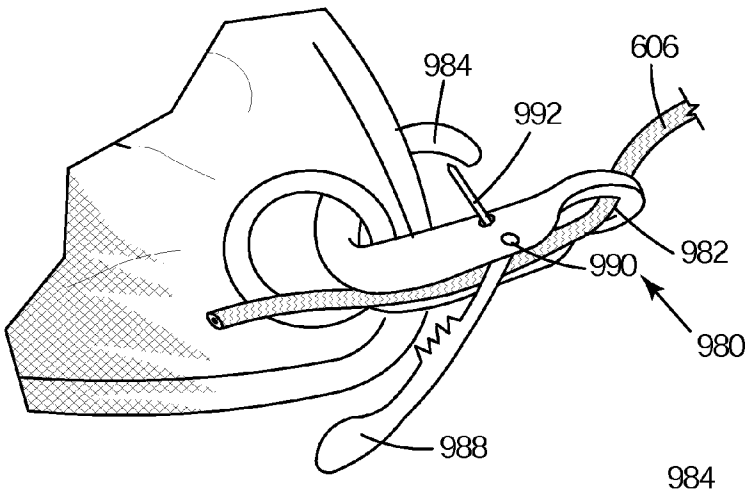
Figure 21C:
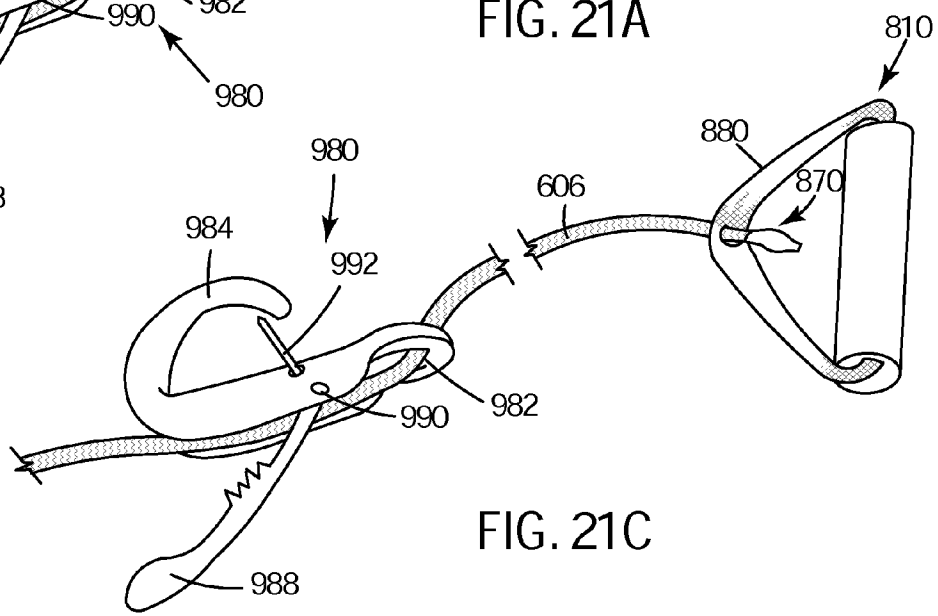

FIGS. 20A and 20B shows an attachment end of a resistance member connected to an attachment point of a flexible base member in the form of a thimble having a locking lever or cam-lever structure to adjustably secure the attachment end of the resistance member. The thimble device 960 in the form of a U-shaped structure having a concave receiving portion 962 is inserted through the aperture 604 forming the attachment point. The thimble device 960 has a first end 964 with an eyelet 966 for receiving the attachment end 610 of the resistance member 606, and a second end 968 with a cam lever arm 970 to secure the resistance member and an eyelet 972. The resistance member 606 is passed through the first end eyelet 966, along the concave receiving portion 962, under the pivot point 974 of the cam lever arm 970 and through the second end eyelet 972. When the cam lever 970 is rotated towards the second end eyelet 972 with the resistance member 606 under its pivot point 974, the resistance member 606 is frictionally secured by the compression of the cam lever arm 970 having ridges 976 on one side and against ridges 978 in the lever receiving portion 962. The ridges 976, 978 should be sufficiently dull to prevent cutting or excess abrasion to the resistance member 606, particularly in embodiments in which the resistance member 606 is a resistance tube formed of soft material (in contrast to more durable bungee cord material). Accordingly, one can adjust the length of the resistance member 606, and thereby increase or decrease the resistance accordingly.

Alternatively, the resistance member 606 can pass through the lever end first, and the lever 970 is provided to lock in the opposite direction (i.e., away from the second end eyelet 972).

FIGS. 21A-22C show another embodiment of a thimble structure having a locking lever or cam lever to secure the resistance member 606. For instance, the handle structure 810 shown with respect to 18B, e.g., having the bulbous pea portion 870 holding it in place, has a lever-locked thimble hook structure 980 attached to the attachment end 610 of the resistance member. The lever-locked thimble hook structure 980 includes an eyelet 982 at its receiving end, a hook structure 984 for engaging the attachment point 104, a concave receiving portion 986, a cam lever arm 988, and a lever pivot point 990. The hook structure 984 can optionally include a latch 992 to prevent the lever-locked thimble hook structure 980 from disengaging with the attachment point 102. The attachment end 610 of the resistance member 606 is passed through the eyelet 982, under the pivot point 990 and along the concave receiving portion 986. When the cam lever arm 988 is rotated away from the eyelet 982 with the resistance member 606 under its pivot point 990, the resistance member 606 is frictionally secured by the compression of the lever 988 having ridges 994 on one side and against ridges 996 in the concave receiving portion 986. The ridges 994, 996 should be sufficiently dull to prevent cutting or excess abrasion to the resistance member 606, particularly in embodiments in which the resistance member 606 is a resistance tube formed of soft material (in contrast to more durable bungee cord material).

While various structures are provided for attaching the resistance member to the flexible base member and/or the handle structure, other structures or configurations are possible. For instance, the resistance member can be knotted through an attachment point. Further, a suitable tie-block as are known in the nautical industry can also be used. Other variations are also possible.

When an individual uses the exercise device on a seat or other surface not having a back portion, such as on a bench or bed, the device is generally limited to being placed under the buttocks of an individual. When an individual sits on the device, his or her weight acts as a stabilizing force, such that when the individual extends the resistance bands, the individual's weight maintains stability.

The materials of construction for the various components of the portable exercise device of the present invention can vary depending on the requisite durability, intended loading capacity of the resistance members, intended user, and other factors.

For instance, the flexible base member can be provided with or without interior padding such as one or more foam cushions, one or more memory foam cushions, one or more gel packs, synthetic fill material, down material, feathers, cotton, hypoallergenic material, buckwheat, loose plastic buckwheat imitation material, rice, or any other suitable fill material. In further alternatives, the flexible base member can be inflatable with a suitable gas, liquid or gel. The fill/inflation material can be in one large pocket, whereby the user can move the material from the outside to provide a confirming shape, or separate compartments, for instance, as shown with respect to FIG. 7.

The material for the flexible base member, with or without filling, can include a variety of materials, preferably having a high degree of flexibility to allow a user to fold, crumple or roll the flexible base member into a very small volume to enhance portability. In addition, the material should be sufficiently strong to withstand the load, particular, at the peripheries where grommets can be situated as attachment points in certain embodiments. For instance, the material can comprise canvas, nylon, vinyl, natural or synthetic leather, foam, rubber, rubberized fabric, carbon fiber, Mylar, Kevlar, or any other suitable flexible material or combination of a plurality of suitable flexible materials.

In addition, the resistance members can be formed of any suitable resilient material. In certain embodiments, a kit can be provided to a user with a variety of resistance members of different type and/or load. For instance, the resistance members can comprise bungee cord, resistance tubes (e.g., silicone or rubber tubes), silicone or rubber cords, or springs of a suitable length, thickness or other characteristics to provide the desired load and range of motion to a user. In certain embodiments, particularly in which a short range of motion is suitable, bungee cords are desirable due to the durability over time. In other embodiments, in which a larger range of motion is desired, resistance tubes are desirable due to the ability to customize the length, various levels of resistance offered, and resistance over a long range of motion.

In embodiments using grommets at the attachment points of the flexible base member, the grommets can be formed of plastic or a suitably formable metal such as brass. In additional embodiments, the grommets can be formed of rubber or synthetic rubber.

Furthermore, various other structures can be provided on the flexible base member, such as one or more pockets (e.g., for holding various sundry items, electronic devices such as music players or exercise counters), rings for attaching keys and the like, bottle holders, a bladder for holding drinking fluids, and other attachments.

The exercise device of the present invention can also, in certain embodiments, be used as a cushion when not in use for performing stretching, conditioning and/or strengthening excursuses.

The apparatus of the present invention has been described above and in the attached drawings; however, modifications will be apparent to those of ordinary skill in the art and the scope of protection for the invention is to be defined by the claims that follow.

The invention claimed is:

1. An exercise device, which comprises:

a) a flexible base member that is removably positionable between a seat and body of a user, said base member having opposed surfaces and being symmetrically configured about a generally central axis, and having opposed tapered sides such that one end is greater in dimension than the other, the longer side having generally arcuate corners and the shorter side having generally obtuse corners, said base member having surface dimensions sufficient to extend at least substantially over the entire buttock area of the user, whereby during use, the configuration and dimension of the base member provides substantially full immovable contact with substantially the entire buttock area of the user on one surface and with the seat on the other surface without need for fasteners, said base member being made of a material which is foldable, yet of sufficient strength to withstand tensile and shear forces;

b) a plurality of apertures located inwardly of respective peripheral edges of said base member to facilitate attachment of resilient resistance members for exercise purposes; and c) at least one resilient resistance member being attachable to said base member through a select one or more of said apertures so as to extend generally outwardly from said base member, each said resistance member having an attachment end and a free end, each said resistance member having a gripping device attached to the free end thereof to facilitate exercise movements by the user, whereby a user may position said base member between a selected portion of the body of the user and the seat to provide firm and immovable contact therebetween and to thereby grip and extend selective ones of said resistance members against their natural resistance for exercise purposes, said flexible member further being capable of being folded, crumpled and rolled for portability and ease of storage.

2. The exercise device as in claim 1, wherein said flexible base member comprises a centrally disposed cushion, and at least one periphery edge margin dimensioned for said plurality of apertures.

3. The exercise device as in claim 1, wherein said flexible base member comprises a centrally disposed pocket for removably supporting a pillow or cushion, and at least one periphery edge margin dimensioned for said one or more attachment points.

4. The exercise device as in claim 1, wherein each said aperture is reinforced to form an attachment point for each said resilient member.

5. The exercise device as in claim 4, wherein each said reinforced aperture includes a grommet.

6. The exercise device as in claim 1, wherein the attachment end of the resistance member comprises a hook, a loop, an eyelet, a ball, or a knot.

7. The exercise device as in claim 1, wherein each said resistance member comprises a bungee cord, a silicone resistance tube, a rubber resistance tube, a silicone cord, or a rubber cord.

8. The exercise device as in claim 7, wherein each attachment end of each said resistance member comprises a rope thimble having a concave groove within which said resistance member is seated, said resistance member being attached to itself at a back end of said rope thimble and seized.

9. The exercise device as in claim 7, wherein said attachment end of each said resistance member comprises a rope thimble including a cam lever arm, wherein the terminal end of said resistance member passes under a pivot point of a cam lever arm and the overall length of said resistance member is adjustable.

10. The exercise device as in claim 1, wherein said attachment end of the resistance member comprises an eyelet secured to a terminal end of the resistance member through a sleeve of the eyelet.

11. The exercise device as in claim 1, wherein the attachment end of the resistance member comprises an eyelet structure secured to a terminal end of the resistance member through an aperture on an end of the eyelet structure with a twist lock ball skewer member.

12. The exercise device as in claim 1, wherein a pair of handle portions are provided, each said handle portion extending from each said symmetrical side about said generally central axis.

13. The exercise device as in claim 1, wherein one symmetrical side includes at least one loop fastener portion, and the other symmetrical side includes at least one hook fastener at a position complementary to the position of the loop fastener.

14. The exercise device as in claim 1, wherein each said resistance member comprises a spring.

15. An exercise device, which comprises:

a) a flexible base member that is removably positionable between a seat and body of a user, said base member having opposed surfaces and being symmetrically configured about a generally central axis, and having opposed tapered sides such that one end is greater in dimension than the other, the longer side having generally arcuate corners and the shorter side having generally obtuse corners, said base member having surface dimensions sufficient to extend at least substantially over the entire buttock area of the user, whereby during use, the configuration and dimension of the base member provides substantially full immovable contact with substantially the entire buttock area of the user on one surface and with the seat on the other surface without need for fasteners, said base member being made of a material which is foldable, yet of sufficient strength to withstand tensile and shear forces;

b) a plurality of reinforced apertures located inwardly of respective peripheral edges of said base member to facilitate attachment of a select number of resilient resistance members for exercise purposes; and c) said resilient resistance members being attachable to said base member through a select one or more of said apertures so as to extend generally outwardly from said base member, each said resistance member having a gripping device attached to a free end thereof to facilitate exercise movements by the user, whereby a user may position said base member between a selected portion of the body of the user and the seat with said end of greater dimension adjacent a select portion of the body corresponding as closely as possible to said end, to provide firm and immovable contact therebetween and to thereby grip and extend selective ones of said resistance members against their natural resistance and the resistance of said base member for exercise purposes, said flexible member further being capable of being folded, crumpled and rolled for portability and ease of storage.

* * * * *